US006244830B1

(12) United States Patent
Agner

(10) Patent No.: US 6,244,830 B1
(45) **Date of Patent: *Jun. 12, 2001**

(54) VANE-CELL PUMP

(75) Inventor: Ivo Agner, Bad Hamburg (DE)

(73) Assignee: Luk, Fahrzeug-Jydraulik GmbH & Co. KG, Bad Homburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/995,498

(22) Filed: Dec. 22, 1997

(30) Foreign Application Priority Data

Dec. 23, 1996 (DE) ..... 196 54 831
Mar. 13, 1997 (DE) ..... 197 10 378

(51) Int. Cl.[7] ..... F04B 23/10; F01C 1/00
(52) U.S. Cl. ..... 417/204; 418/268
(58) Field of Search ..... 417/204; 418/268

(56) References Cited

U.S. PATENT DOCUMENTS 4,183,723 * 1/1980 Hansen et al. ..... 417/204
4,354,809 * 10/1982 Sundberg ..... 418/268
4,355,965 * 10/1982 Lowther ..... 418/111
4,386,891 6/1983 Riefel et al. ..... 418/81
4,697,990 10/1987 Dantlgraber et al. ..... 417/204
5,147,183 9/1992 Gettel ..... 417/300
5,154,593 * 10/1992 Konishi et al. ..... 418/77
5,466,135 * 11/1995 Draskovits et al. ..... 418/268

FOREIGN PATENT DOCUMENTS 2 097 475 11/1982 (GB) .

* cited by examiner

*Primary Examiner*—Charles G. Freay
*Assistant Examiner*—Paul Ratcliffe
(74) *Attorney, Agent, or Firm*—Fitch, Even, Tabin & Flannery

(57) ABSTRACT

A vane-cell pump, has a rotor that is arranged in a lifting ring that forms at least one suction region and one pressure region. Radial slots extend over the entire width and are arranged on the circumferential surface of the rotor. Vanes are arranged in the slots in a radially movable manner, with stationary lateral limiting surfaces (lateral surfaces) that adjoin the rotor and the lateral edges of the vanes in a sealing manner. At least one of the lateral surfaces comprises a groove that extends within the range of motion of lower vane chambers and the other lateral surface comprises at least one lower vane pocket that is assigned to the suction region and connected to the pressure region within the range of motion of the lower vane chambers.

16 Claims, 3 Drawing Sheets

KEY: 1 DEGREES

KEY: 1 DEGREES

VANE-CELL PUMP

BACKGROUND OF THE INVENTION

1. Field of the Invention

The invention pertains to vane-cell machines, and in particular, to vane-cell pumps.

2. Description of the Related Art

Conventional vane-cell machines are generally known, and comprise a rotor that rotates inside of a lifting ring that is arranged in a housing. The lifting ring has a contour that does not extend coaxially to the rotational axis of the rotor and forms at least one pump chamber. The rotor comprises radially extending slots, in which radially movable vanes are arranged. During the rotation of the rotor, the vanes are guided along the contour of the lifting ring, wherein respective chambers with changing volumes are formed between two adjacent vanes. In this case, a suction region and a pressure region are formed in accordance with the rotational movement of the rotor, wherein the suction region is arranged within the region of increasing volumes and the pressure region is arranged within the region of decreasing volumes. The suction region is connected to a suction connection of the vane-cell machine, and the pressure region is connected to a pressure connection of the vane-cell machine such that a fluid, e.g., oil, can be conveyed.

Machines known as lower vane pumps make up a lower vane pocket arranged within the suction region. The lower vane pocket is arranged in a lateral surface that limits the pump chamber. This lower vane pocket is connected to the pressure region of the vane-cell pump. The lower vane pocket is arranged in such a way that it is situated within the range of motion of lower vane chambers formed underneath the vanes in the slots in the rotor. In this case, the lower vane pocket extends over a certain rotational angle such that several lower vane chambers are simultaneously situated within the region of the lower vane pocket. Consequently, a fluid connection between the lower vane chambers and the lower vane pocket is attained, wherein the total surface of said fluid connection corresponds to the sum of the partial surfaces of the individual lower vane chambers that are currently in contact with the lower vane pocket.

The lower vane chambers change their cross-sectional surfaces in accordance with the rotational movement of the rotor and consequently change the radial position of the vanes, so the total surface also varies. The term "total surface" or "partial surface" of the fluid connection refers to the free cross-sectional surface of the fluid connection between the lower vane groove and the lower vane chambers situated within the region of a lower vane groove. The volume flow pulsation of the lower vane pump is superimposed on the volume flow pulsation of the upper vane pump and thus forms the total volume flow pulsation of the vane-cell pump.

In conventional vane-cell pumps, the lower vane pocket that is assigned to the suction region extends over a relatively large rotational angle of the rotor, i.e., the lower vane pressure pockets that are also situated within the range of motion of the lower vane chambers can only extend over a relatively small rotational angle. These lower vane pressure pockets are also connected to the lower vane pocket via the lower vane chambers and a circumferential groove in a second lateral surface, or four pockets are connected to one another via a fluid connection that is open toward the lower vane chambers.

SUMMARY OF THE INVENTION

Although a relatively good pulsation behavior is attained with the lower vane pocket that extends over a relatively large rotational angle, such a vane-cell pump has an inferior cold-starting behavior due, it is believed, to the fact that the lower vane pressure pocket extends over a relatively small rotational angle. The lower vane pressure pockets are subjected to a pressure build-up via the lower vane pocket, the lower vane chambers, and the revolving groove. The pressure build-up counteracts the inward motion of the vanes during their movement into the pressure region of the vane-cell pump and is intended to dampen this inward motion.

The present invention is based on the objective of developing a vane-cell machine, in particular, a vane-cell pump, of the initially mentioned type, which is characterized by a superior pulsation behavior of the lower vane pump as well as a superior cold-starting behavior.

According to one aspect of the invention, this objective is attained with a vane-cell pump, including:

a housing;

a lifting ring within the housing, that forms at least one suction region and one pressure region;

a rotor mounted for rotation within the lifting ring, the rotor having a circumferential surface and radial slots that are arranged on the circumferential surface of the rotor;

a plurality of radially spaced apart vanes having lateral edges and arranged in said slots in a radially movable manner so as to cooperate with said lifting ring to form lower vane chambers between adjacent vanes;

first and second stationary, lateral surfaces carried on at least one of said housing and said lifting ring, said lateral surfaces adjoining the rotor and the lateral edges of the vanes in a sealing manner;

said first lateral surface comprising a groove that extends within the range of motion of the lower vane chambers and is open toward these lower vane chambers;

said second lateral surface defining a lower vane pocket which is coupled to the pressure region, extending a predetermined angular amount over an angular range of travel of said rotor, being located in the suction region and also within the range of motion of the lower vane chambers;

a fluid connection between the lower vane pocket and the groove, formed by the lower vane chambers that are currently situated within the region of the lower vane pocket;

at least one lower vane pressure pocket that is located in the pressure region and also within the range of motion of the lower vane chambers, being also defined by the second lateral surface; and the lower vane chambers having outer surface portions defined while the lower vane chambers reside within the lower vane pocket, said outer surface portions defined by a cross sectional plane passing through the region of the lower vane pocket and through a lower vane chamber located within the lower vane pocket, with the outer surface portions of the lower vane chambers remaining substantially constant during the revolution of the rotor.

Since the lower vane pocket extends over a rotational angle of preferably 58° to 71° and the total surface of the fluid connection remains essentially constant during the rotation of the rotor, it is possible to attain a low pulsation (via the total surface) that remains essentially constant and to simultaneously provide sufficient space for realizing the lower vane pressure pocket over a larger rotational angle because the lower vane pocket merely extends over a rotational angle of 58° to 71°, i.e., a superior cold-start and high-speed behavior is ensured.

Due to the fact that the lower vane pocket extends over a rotational angle of 58° to 71°, it is possible to provide a ten-vane vane-cell machine with one lower vane chamber which moves into the region of the lower vane pocket while another lower vane chamber moves out of the region of the lower vane pocket. The actual rotational angle, over which the lower vane pocket extends, depends on the width of the lower vane chambers—viewed in the rotating direction. The wider the lower vane chambers, the smaller the rotational angle over which the lower vane pocket extends.

According to one preferred embodiment of the invention, it is proposed that the lower vane pocket and the groove section situated opposite to the lower vane pocket have a contour that changes identically over the rotational angle of the vanes, i.e., these components are a mirror image. Accordingly, the surfaces of the individual lower vane chambers (partial surfaces), which change during the rotational movement of the rotor, are taken into consideration in accordance with the momentary position of the rotor, i.e., an essentially constant total surface of the fluid connection can be ensured over the entire lower vane pocket. Preferably, a continuously tapered contour section is provided at the end of the lower vane groove viewed in the rotating direction of the rotor. The surface increase caused by a lower vane chamber that moves into the region of the lower vane pocket is advantageously compensated such that the total surface can essentially be maintained constant.

According to another preferred embodiment of the invention, it is proposed that the lower vane pocket is, in reference to the suction region, arranged such that the movement of a lower vane chamber into the region of the lower vane pocket, and the simultaneous movement of an additional lower vane chamber out of the region of the lower vane pocket, takes place in an angular position of the rotor in which the kinematic volume flow of the lower vane pump is at its minimum. The volume flow progression is not very steep at this time, i.e., the volume flow pulsation of the lower vane pump is only minimally influenced by the surface changeover.

Additional advantageous features of the invention will become apparent from studying the appended description and drawings.

DETAILED DESCRIPTION OF THE PREFERRED EMBODIMENT

Figure 1:
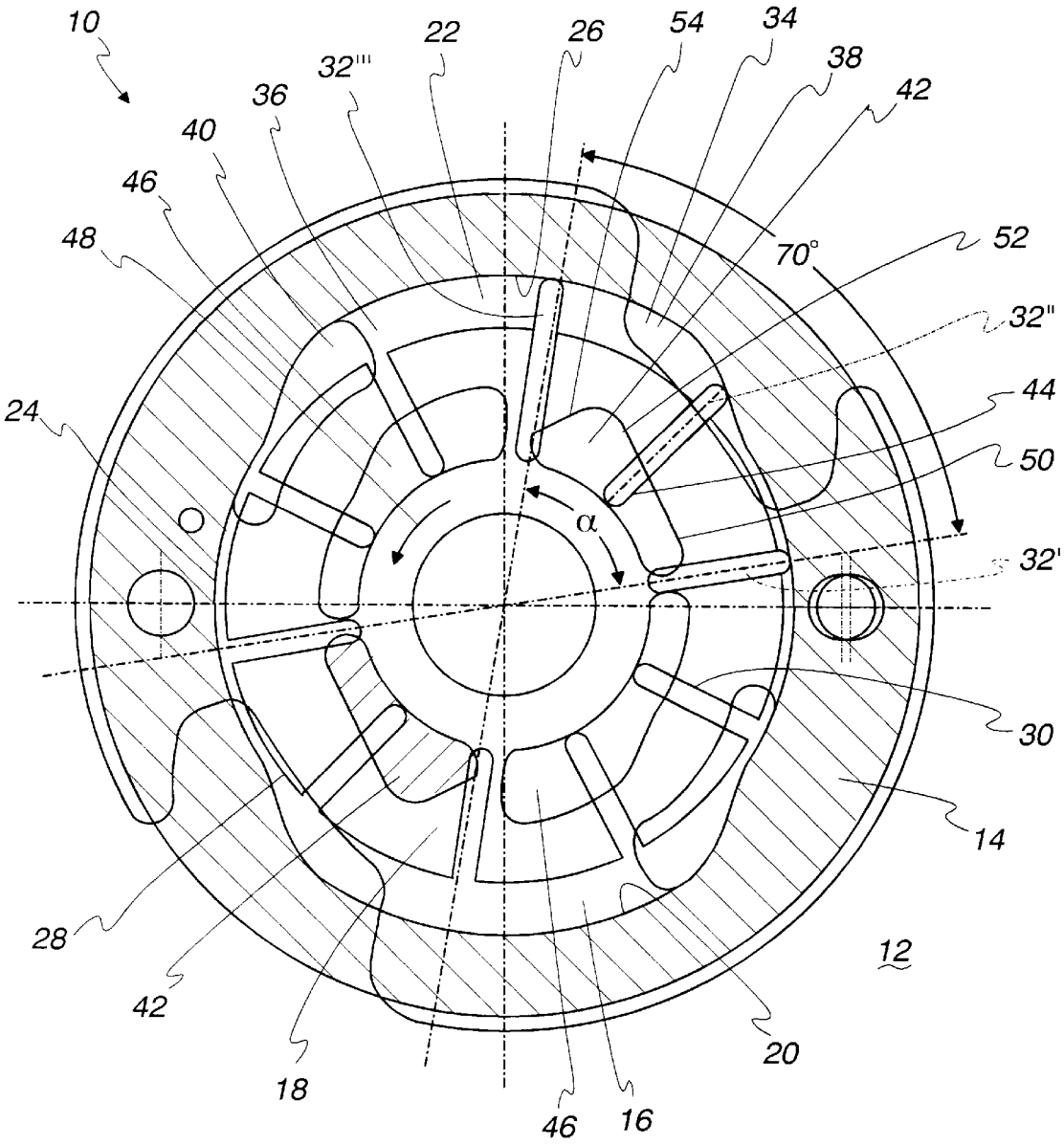
FIG. 1 a top view of an open vane-cell pump.

FIG. 1 shows a partial view of an open vane-cell machine that is realized in the form of a vane-cell pump 10. The vane-cell pump 10 comprises a lifting ring 14 that is arranged inside of a housing 12 in a rotationally rigid manner. The lifting ring 14 encloses an inner space 16, inside of which a rotor 18 is arranged. An inner contour of the lifting ring 14, which is referred to as the contour 20 below, is chosen such that two diametrically opposing pump chambers 22 are formed between the outer circumference of the rotor 18 and the inner surface of the lifting ring 14. For this purpose, the contour 20 forms a small circle 24, the diameter of which essentially corresponds to the outer diameter of the rotor 18. The contour 20 also forms a so-called large circle 26, the diameter of which is larger than the outer diameter of the rotor 18, i.e., the pump chambers 22 are formed. The transition regions between the small circle 24 and the large circle 26 have a certain progression that is described in detail below with reference to FIGS. 2 and 3.

The rotor 18 comprises radially extending slots 30 that are distributed over its circumferential surface 28. In the embodiment shown, a total of ten slots 30 are provided within a uniform angular pitch, i.e., the slots 30 are respectively spaced apart by 36° viewed in the circumferential direction. Radially movable vanes 32', 32", and 32'" are arranged in the slots 30, wherein only three vanes are illustrated in the figure so as to provide a better overview. The slots 30 and the vanes extend over the entire width of the rotor 18.

A suction region 34 and a pressure region 36 are assigned to each pump chamber 22. The suction region 34 is connected to a suction connection of the vane-cell pump 10 via a suction pocket 38, with the pressure region 36 being connected to a pressure connection of the vane-cell pump 10 via a pressure pocket 40.

The inner space 16 and consequently the pump chambers 22 are closed on both sides by lateral surfaces 56 and 58 (see FIGS. 6–8), wherein one of said lateral surfaces is not illustrated in FIG. 1, such that the pump chamber 16 is visible. The lateral surfaces are rigidly connected to the housing 12 and/or the lifting ring 14 and tightly adjoin the lateral surfaces of the rotor 18 or the lateral edges of the vanes 32, respectively. Due to this measure, the pump chambers 22 are sealed in a nearly pressure-tight manner.

One lateral surface that, for example, is formed by the housing 12 comprises a lower vane pocket 42 that is assigned to each suction region of a pump chamber 22 and is connected to the pressure region of the vane-cell pump 10 via a fluid connection that is not illustrated in detail. The lower vane pocket 42 extends over an angle $\acute{a}$ of 70°. The angle $\acute{a}$ of 70° was chosen for the embodiment shown and may vary between 58° and 71°.

The lower vane pockets 42 lie within the range of motion of lower vane chambers 44 formed inside of the rotor 18 between the vanes 32 and the base of the slots 30. In addition, one respective lower vane pressure pocket 46 is arranged angularly offset to the lower vane pockets 42 within the range of motion of the lower vane chambers 44. The lower vane pressure pockets 46 are formed by depressions in the lateral surface and have a contour that is described in detail below.

The contour of the lower vane pockets 42 comprises, if viewed from the top, a first or upstream, constant-contour section 50 (i.e., first with reference to the rotating direction 48 of the rotor 18). Essentially, the radially inner and outer limiting surfaces of this contour section extend concentric to one another. The first contour section 50 is transformed or blended into a contour section 52 that preferably widens continuously and is primarily determined by the vane progression. This contour section is transformed into a counter section 54 that is preferably tapered continuously.

The other lateral surface that is not shown in FIG. 1 and, for example, is formed by a cover of the vane-cell pump 10, has a groove that circumferentially extends within the range of motion of the lower vane chambers 44 and is open in the direction of the lower vane chambers. This groove is situated opposite to the lower vane pockets 42 and the lower vane pressure pockets 46 and has a contour that exactly corresponds to the contour of the lower vane pockets 42 and the lower vane pressure pockets 46. However, this circumferential groove is realized continuously such that a continuous fluid connection is ensured over the entire circumference of the groove.

According to another embodiment, the groove may be formed by four pockets that are connected to one another via a fluid connection. With respect to their position, these pockets are directly assigned to the lower vane pockets 22 and the lower vane pressure pockets 46. The fluid connection may be realized on the lateral surface or in the rotor.

The function of a vane-cell pump 10 is generally known, and, accordingly, only the essential aspects of the invention are discussed herein. The rotor 18 is turned—in the rotating direction 48—via a drive unit (not shown) such that the vanes 32', 32", and 32'" are guided along the contour 20. At the transition from the small circle 24 to the large circle 26, the vanes are moved radially outward such that a chamber with a changing volume is formed between two adjacent vanes. Consequently, fluid is drawn into the suction region 34 via the suction pocket 38. At the transition between the large circle 26 and the small circle 24, i.e., the pressure region 36, the vanes 32 are pressed radially inward such that the volume of the chamber situated between two adjacent vanes 32 is reduced and the previously drawn-in fluid is pressed out via the pressure pockets 40. This means that a certain volume flow of a conveyed fluid is adjusted in accordance with the rotational speed of the rotor 18. Due to the connection (not shown), this conveyed fluid is also present in the lower vane pockets 42 that are assigned to the suction regions 34. The lower vane chambers 44 are moved past the lower vane pockets 42. Since the vanes 32 move radially outward in the suction region 34, the free cross-sectional surface between the lower vane chambers 44 and the lower vane pocket 42 is increased within this region. The fluid conveyed in the lower vane chambers 44 presses the vanes 32 radially outward from the bottom. Consequently, it is ensured that the vanes adjoin the inner contour 20 and that adjacent chambers situated between two respective vanes 32 are sealed. At least two lower vane chambers 44 are always situated within the region of a lower vane pocket 42 in accordance with the position of the rotor 18. This results in a total surface that is formed by the partial surfaces of the lower vane chambers 44 currently situated within the region of the lower vane pocket 42. The groove in the lateral surface (not shown) produces a fluid connection between the lower vane pockets 42 and the lower vane chambers 44 currently situated congruent to said lower vane pockets, as well as the groove and the lower vane pressure pockets 46. Consequently, a pressure also acts radially outward upon the vanes within the pressure region 36 of the vane-cell pump 10 such that the motion of the vanes is dampened during their radial inward movement.

The moving vanes and the changing volumes of the lower vane chambers together generate a pulsating volume flow (lower vane pump) that is able to flow to the pressure region via the above-mentioned fluid connection. The volume flow and the speed of the fluid flow depend on the variability of the above-mentioned total surface. This volume flow pulsation is superimposed on the volume flow pulsation of the upper vane pump with the opposite preceding sign, i.e, the volume flow pulsation in the entire vane-cell pump 10 is compensated. Consequently, the volume flow pulsation of the lower vane pump is reduced. This low-volume pulsation of the lower vane pump essentially depends on the kinematics of the vane-cell pump 10, i.e., the rotational speed of the rotor 18 as well as the radial motion of the vanes and the total surface of the lower vane chambers 44 that are currently situated congruent to the lower vane pocket 42.

Figure 2:
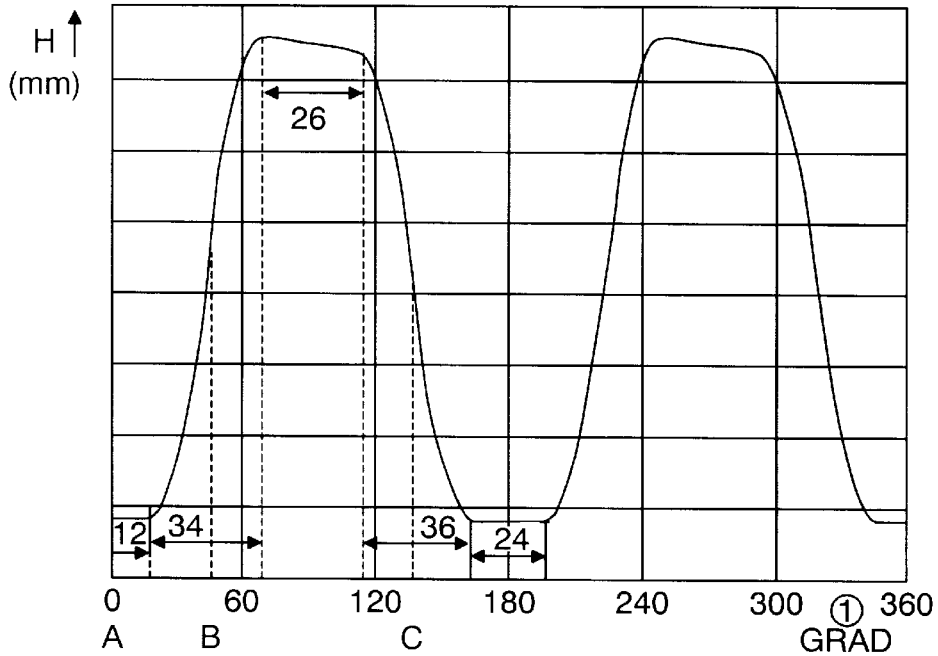
FIG. 2 shows the progression of the lift as a function of the rotational angle.
Figure 3:
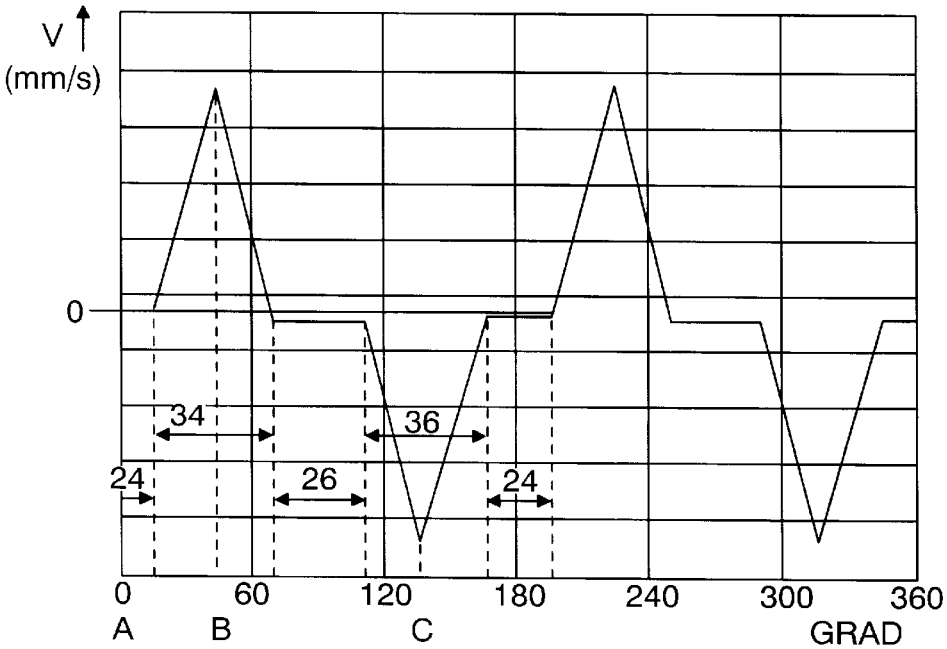
FIG. 3 shows the progression of the radial speed of one vane as a function of the rotational angle.

FIGS. 2 and 3 show a developed view of the contour 20 of the lifting ring 14 as a function of the rotational angle of a vane 32', 32", or 32'". This diagram begins at a point that corresponds to the zero point and is identified by the reference symbol A in FIG. 1 and shows one full revolution by 360°. FIG. 2 shows the radial lift H of one vane, with FIG. 3 showing the radial speeds the of the vanes 32', 32", 32'".

The progression of the lift shown in FIG. 2 indicates that the vanes are, beginning at point A, initially not subjected to a lift in the small circle 24. An ascending branch that corresponds to the passage through the suction region 34 ensues. The point B that indicates the so-called turning point lies within the suction region 34, i.e., the radial lift H progressively increases up to point B. During this process, the vane moves with a continuously increasing radial speed v (FIG. 3). Beginning at point B. the radial speed v drops to a value of zero due to the decreasing progression of the lift H, wherein the vane 32 begins to move into the large circle 26 beginning at this point. Within the large circle 26, the radial speed v essentially remains at a value near zero, until the vane 32 moves into the pressure region 36. While passing through the pressure region 36, the radial lift H decreases to the minimum value in the small circle 24. Up to a turning point C, this results in an increasingly negative radial speed v, i.e., a radially inwardly directed speed. Beginning at the turning point C, the speed v decreases until the small circle 24 is reached and subsequently increases to the zero value. Due to the double-lift design of the vane-cell pump 10, the radial lift H or the progression of the radial speed v is repeated for each vane 32. The radial speed v is directly proportional to the volume flow generated by one vane 32 during one revolution of the rotor 183 of the vane-cell pump 10.

Figure 4:
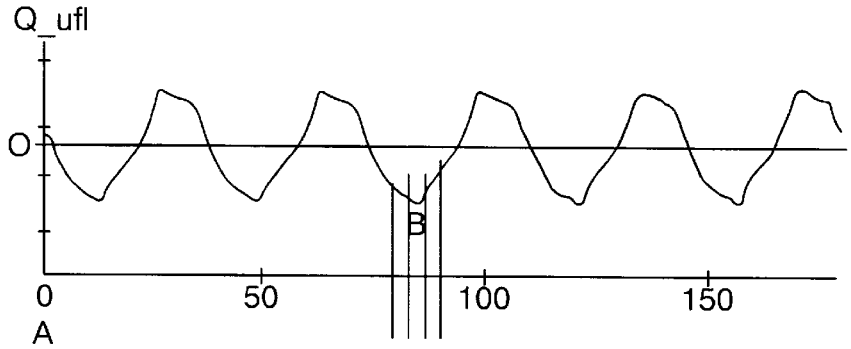
FIG. 4 shows the volume flow progression of the lower vane pump.

FIG. 4 shows the volume flow O of the lower vane pump. The volume flow O shown in this figure is realized with a vane-cell pump 10 with ten vanes 32 that are offset relative to one another by 36° as shown in FIG. 1. In this case, the volume flow O pulsates about a fixed point (zero line), wherein the surface enclosed by the curve underneath the line corresponds to the suction mode of the lower vane pump and the surface enclosed by the curve above the zero line corresponds to the pressure mode of the lower vane pump. A minimum of this progression is defined by the turning point identified by the reference symbol B in the ascending branch of the lift H, which coincides with the maximum of the radial speed v. The maximum of the volume flow O coincides with the turning point identified by the reference symbol C in the descending branch of the lift H, which coincides with the minimum of the radial speed v. In FIGS. 2 and 3, the definition of points B and C pertained to one respective vane; however, in FIG. 4, the progression of the volume flow O is illustrated for the superposition of a total of ten vanes.

Figure 5:
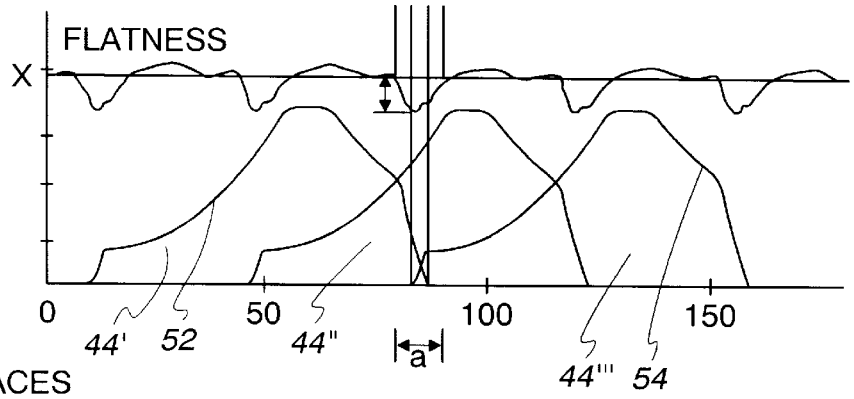
FIG. 5 shows the change of surfaces of lower vane chambers as a function of the rotational angle of the vane-cell pump according to FIG. 1.

In FIG. 5, an upper curve indicates the total of the surfaces of the lower vane chambers 44, which are currently in contact with the lower vane pocket 42 as well as the opposing groove. In the representation of a revolving rotor 18 shown in FIG. 1, these surfaces are indicated in black. According to this figure, a first vane 32' currently moves into the region of the lower vane pocket 42, a second vane 32" currently reaches the ascending contour section 52, and a third vane 32'" currently moves out of the region of the lower vane pocket 42. Consequently, the total surface is composed of three partial surfaces (see FIG. 1). The total surface progression that is illustrated on top in FIG. 5 as a function of the rotational angle results in accordance with the rotation of the rotor 18, i.e., the rotation of all vanes 32 of the vane-cell pump as well as the rotation of the lower vane chambers 44. The diagram illustrates that this surface progression is essentially constant except for slight fluctuations, wherein the deviation from the fixed value (x-line) is relatively small. This is attained due to the previously described contour of the lower vane pocket 42 and the opposing groove. The bottom portion of FIG. 5 shows the individual surface progressions of three lower vane chambers 44; naturally, the surface progressions of a total of ten lower vane chambers 44 would be superimposed in the embodiment according to FIG. 1.

FIG. 5 illustrates that the surface progression of an individual lower vane chamber 44 decisively depends on the radial lift of the vane 32 as well as the contour of the lower vane pocket 42.

In order to illustrate these circumstances, a section of the angular range is identified by the reference symbol a in FIGS. 4 and 5. This section a represents that in which the total surface of the lower vane chambers 44 is slightly smaller than the assumed fixed value. Due to the design and arrangement of the contour of the lower vane pocket, this section is situated such that it coincides with the minimum of the volume flow O of the lower vane chambers. The minimum is—as described previously—defined by the turning point of the contour 20, which is identified by the reference symbol B. The lower vane pocket 42 is stationarily arranged on the lateral surface such that the following results refer to point B: the vane 32' currently moves into the region of the lower vane pocket 42, and the vane 32'" currently moves out of the region of the lower vane pocket 42. Consequently, a surface changeover in the superposition of the total surface of all lower vane chambers 44 situated within the region of the lower vane pocket 42 takes place at this time. These circumstances are elucidated with the aid of the lower portion of FIG. 5, which shows that the surface progression of the lower vane chamber 44'" within the region of point P or section a, respectively, just begins to quantitatively contribute to the total surface, and shows that the surface of the lower vane chamber 44' has just stopped contributing its share to the total surface. The main portion of the total surface is provided by the lower vane chamber 44" at this time. This is attained due to the fact that the lower vane pocket 42 extends over an angle á of 70° and the imaginary center or bisecting line of this angle coincides with point B or the center of the lower vane pocket 42 lies within an angular range within 5° of point B.

The angle á may vary in a dependent relation on the actual design of the vane-cell pump 10, in particular the width of the slots 30 and consequently the lower vane chambers 44. The wider the slots 30 are within their lower region that comes in contact with the lower vane pocket 42, the smaller the angle x. In addition, the angle á also depends on the design of the slot, i.e., depending on whether a simple slot with a radius or a slot with an additional widening at the slot base, a so-called drop shape, is provided.

The previously described arrangement of the lower vane pocket 42 makes it possible for the changeover of the total surface from a lower vane chamber 44, which currently leaves the region of the lower vane pocket 42, to a lower vane chamber 44 which currently moves into the region of the lower vane pocket 42, to lie at the minimum of the kinematic volume flow pulsation of the lower vane pump. Within this region, the volume flow O has a small gradient (steepness) that positively influences the entire volume flow pulsation of the vane-cell pump 10. In addition, the essentially constant total surface of the lower vane chambers 44, which are currently in contact with the lower vane pocket 42, contributes to a superior pulsation behavior of the lower vans pump.

The lower portion of FIG. 5 also illustrates the influence of the continuously increasing contour section 52 and the continuously tapered contour section 54 of the lower vane pocket 42. Due to the design of these sections, the superposition of the surfaces according to the upper portion of FIG. 5 is additionally homogenized, i.e., the total surface essentially remains constant. Due to this measure, a decrease in the total surface, which is indicated by the double arrow, remains as small as possible.

Figure 6:
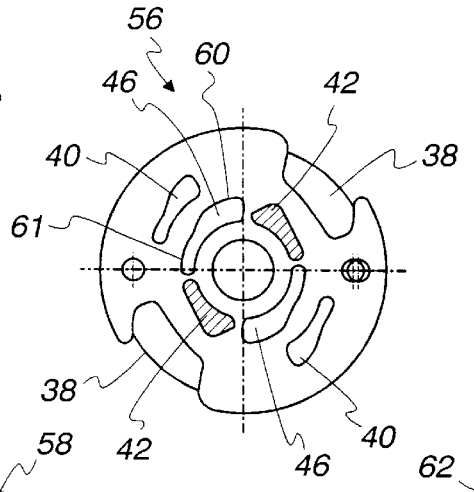
FIG. 6 is a top view of a first lateral surface of the vane-cell pump.
Figure 7:
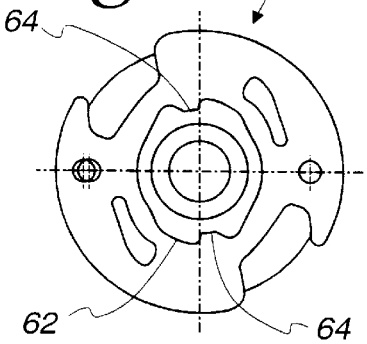
FIG. 7 is a top view of a second lateral surface of the vane-cell pump.
Figure 8:
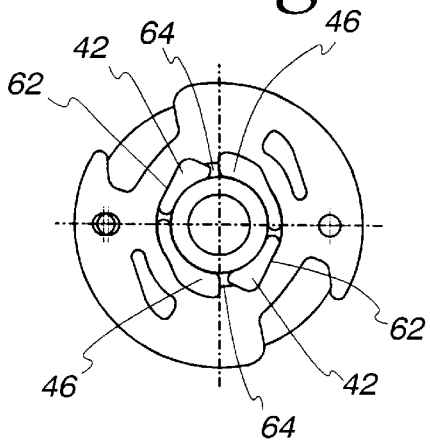
FIG. 8 is a top view of the lateral surfaces of the vane-cell pump according to FIGS. 6 and 7, which are placed on top of one another.

FIGS. 6–8 show the previously discussed lateral surfaces 56 and 58 that, however, are not shown in FIG. 1. FIG. 6 shows the lateral surface 56 that, for example, forms part of the housing 12 of the vane-cell pump 10. FIG. 7 shows the lateral surface 58 that, for example, is formed by a cover of the vane-cell pump 10. The lateral surfaces 56 and 58 respectively adjoin both sides of the pump chamber 16. The lateral surface 56 is provided with the lower vane pockets 42, indicated by a hatching. The lower vane pressure pockets 46, the pressure pockets 40, and suction pockets 38 are also arranged on this lateral surface. These figures show that the lower vane pressure pockets 46 extend over a relatively large angular range of approximately 90° and comprise a first section 60 that—viewed in a cross section or in the radial direction—has a relatively wide structure. The section 60 transforms into a section 61, the width of which corresponds to the width of the groove 62 measured in the radial direction. Due to this measure, a superior cold-starting and high-speed behavior of the vane-cell pump 10 is attained. Consequently, the vane-cell pump 10 is characterized by a superior cold-starting and high-speed behavior as well as a low pulsation attained due to the design and arrangement of the lower vane pocket 42.

FIG. 7 shows a circumferential groove 62 arranged on the lateral surface 58 and open toward the pump chamber 16. The groove 62 has a contour that is identical to the contour of the lower vane pockets 42 and the lower vane pressure pockets 46. This can be ascertained in FIG. 8, in which the lateral surfaces 56 and 58 are illustrated on top of one another. In FIG. 8, the lower lateral surface is the lateral surface 58, wherein the upper lateral surface 56 represents a mirror image of the lateral surface shown in FIG. 6, i.e., the contours of the lower vane pockets 42 and the lower vane pressure pockets 46 are exactly congruent to the corresponding contour sections of the groove 62. Due to this measure, it is ensured that exactly the same surface ratios exist at the connection between the lower vane chambers 44 and the groove 62 as at the connection between the lower vane chambers 44 and the lower vane pockets 42 or the lower vane pressure pockets 46, respectively. The groove 62 also comprises the connections identified by the reference numeral 64, which form a fluid connection between the lower vane pockets 42 and the lower vane chambers 44 as well as between the groove 62 and the lower vane pressure pockets 46.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A vane-cell pump, including:

a housing;

a lifting ring within the housing, that forms at least one suction region and one pressure region;

a rotor mounted for rotation within the lifting ring, the rotor having a circumferential surface and radial slots that are arranged on the circumferential surface of the rotor;

a plurality of radially spaced apart vanes having lateral edges and arranged in said slots in a radially movable manner so as to cooperate with said lifting ring to form lower vane chambers between adjacent vanes;

first and second stationary, lateral surfaces carried on at least one of said housing and said lifting ring, said lateral surfaces adjoining the rotor and the lateral edges of the vanes in a sealing manner;

said first lateral surface comprising a groove that extends within the range of motion of the lower vane chambers and is open toward these lower vane chambers;

said second lateral surface defining a lower vane pocket which is coupled to the pressure region, extending a predetermined angular amount over an angular range of travel of said rotor, being located in the suction region and also within the range of motion of the lower vane chambers;

a fluid connection between the lower vane pocket and the groove, formed by the lower vane chambers that are currently situated within the region of the lower vane pocket;

at least one lower vane pressure pocket that is located in the pressure region and also within the range of motion of the lower vane chambers, being also defined by the second lateral surface; and the lower vane chambers having outer surface portions defined while the lower vane chambers reside within the lower vane pocket, said outer surface portions defined by a cross sectional plane passing through the region of the lower vane pocket and through a lower vane chamber located within the lower vane pocket, with the outer surface portions of the lower vane chambers remaining substantially constant during the revolution of the rotor.

2. The vane-cell pump according to claim 1, wherein the predetermined angular amount ranges between 58 degrees and 71 degrees.

3. The vane-cell pump according to claim 1, wherein the predetermined angular amount comprises approximately 70 degrees.

4. The vane-cell pump according to claim 2, wherein the vane-cell pump comprises ten vanes.

5. The vane-cell pump according to claim 1, wherein said groove is formed by four pocket, defined by said lifting ring, said four pockets being connected together via a fluid connection.

6. The vane-cell pump according to claim 1, wherein the lower vane pocket and a portion of the groove which is situated opposite to the lower vane pocket form a mirror image.

7. The vane-cell pump according to claim 1, wherein the lower vane pocket comprises a radially sequential series of a constant width contour section, a widening contour section, and a tapered narrowing contour section.

8. The vane-cell pump according to claim 7, wherein the widening contour section and the narrowing contour section are continuously tapered.

9. The vane-cell pump according to claim 1, wherein a surface changeover occurs as one lower vane chamber moves into the region of the lower vane pocket while another lower vane chamber leaves the region of the lower vane pocket so as to continuously maintain the total surface of said fluid connection essentially constant.

10. The vane-cell pump according to claim 9, wherein the surface changeover takes place while the volume flow progression (Q) of the pump is at its minimum.

11. The vane-cell pump according to claim 1, wherein the lower vane pocket is arranged in such a way that a bisecting line of the predetermined angular amount lies within the region of a turning point (B) of the contour, at which point the radial speed (v) of the vanes is at its maximum.

12. The vane-cell pump according to claim 11, wherein the bisecting line of the predetermined angular amount lies within an angular range of 5° of the turning point (B).

13. The vane-cell pump according to claim 1, wherein the predetermined angular amount of the lower vane pressure pocket is at least 90 degrees.

14. The vane-cell pump according to claim 11, wherein the lower vane pressure pocket comprises a rotationally leading contour section of predetermined width and a rotationally following section of reduced width corresponding to the width of the groove.

15. A vane-cell machine with a rotor that is arranged in a lifting ring that forms at least one suction region and one pressure region, wherein radial slots that extend over the entire width are arranged on the circumferential surface of the rotor, and wherein vanes are arranged in the aforementioned slots in a radially movable manner, with stationary lateral limiting surfaces that adjoin the rotor and the lateral edges of the vanes in a sealing manner, wherein at least one of the lateral surfaces comprises a groove that extends within the range of motion of the lower vane chambers and is open toward these lower vane chambers, and wherein the other lateral surface comprises at least one lower vane pocket that is assigned to the suction region and connected to the pressure region within the range of motion of the lower vane chambers such that a fluid connection between the lower vane pocket and the groove is, in accordance with the rotor position, produced by the lower vane chambers that are currently situated within the region of the lower vane pocket, and with at least one lower vane pressure pocket that is assigned to the pressure region and arranged within the range of motion of the lower vane chambers in the second lateral surface that also comprises the lower vane pocket, being characterized by the fact that the lower vane pocket extends over an angular range, and by the fact that the total cross-sectional surface of the lower vane chambers situated within the region of the lower vane pocket remains essentially constant during the revolution of the rotor.

16. Vane-cell machine according to claim 15, characterized by the fact that the angle lies between 58° and 71°, in particular at 70°, and by the fact that the vane-cell machine comprises ten vanes.

* * * * *